US006266902B1

(12) United States Patent
Dettwiler

(10) Patent No.: US 6,266,902 B1
(45) Date of Patent: Jul. 31, 2001

(54) PULL-OUT SLEEVE IRONING WITH DETENT STOPS

(76) Inventor: Stefan R. Dettwiler, Stalden 33, 4500 Solothurn (CH)

( * ) Notice: Subject to any disclaimer, the term of this patent is extended or adjusted under 35 U.S.C. 154(b) by 0 days.

(21) Appl. No.: 09/458,989

(22) Filed: Dec. 10, 1999

(51) Int. Cl.[7] ..... D06F 81/10
(52) U.S. Cl. ..... 38/135
(58) Field of Search ..... 38/135, 137, 138, 38/20; 108/65, 64, 102

(56) References Cited

U.S. PATENT DOCUMENTS

| | | | |
|---|---|---|---|
| 2,888,759 | 6/1959 | Vennen . | |
| 3,698,110 | 10/1972 | Shettel . | |
| 4,809,450 | 3/1989 | Hochstrasser et al. . | |
| 4,910,896 * | 3/1990 | Ruschitzka | 38/135 X |
| 5,016,367 * | 5/1991 | Breen et al. | 38/135 |

FOREIGN PATENT DOCUMENTS 0 458 503 11/1991 (EP) .

2 614 326 10/1988 (FR) .

* cited by examiner

*Primary Examiner*—Ismael Izaguirre
(74) *Attorney, Agent, or Firm*—Browdy and Neimark

(57) ABSTRACT

An ironing board has a main board and a smaller sleeve board which is separable for ironing sleeves and small items. The sleeve board slides relative to the main board on a slide mechanism, which preferably includes a number of parallel slides, in such a way that the main board and the sleeve board remain coplanar. To hold the sleeve board in its offset position, the slide mechanism has stops which hold the sleeve board in the offset position (in which a gap separates the main board and the sleeve board) and the juxtaposed position, in which the sleeve board is pressed against the main board. The stops are releasable by click detents, release buttons or knobs, or the like, so that the sleeve board can be moved between the juxtaposed and offset positions. Preferably, the detents comprise indentations and teeth pressed together by springs or the weight of some part of the device.

20 Claims, 1 Drawing Sheet

PULL-OUT SLEEVE IRONING WITH DETENT STOPS

FIELD OF THE INVENTION

The present invention relates to ironing boards for use with hand-held irons and having separable portions intended for auxiliary ironing operations, such as for example ironing sleeves.

REVIEW OF THE RELATED TECHNOLOGY

Several patents are know to relate to the field of the present invention.

FR 2,614,326 shows in FIGS. 1–4 a device with a flat surface having portions 1 and 5. Portion 5 appears to be slidable away from portion 1 on rods 4 sliding in tubes 3. The displacement of the rods 4 in the tubes 3 appears to be limited by pins 8 sliding in slots 9. No detents or stops are disclosed in the slide mechanism. The line between the portions is straight and angled to the major side of the flat surface, which is rectangular (page 3, line 28).

U.S. Pat. No. 4,809,450 shows an ironing press board with a board having two parts 9 and 10. Part 9 is separately usable as a sleeve-board. Part 10 mounted on a sliding carriage 11 (shown in FIG. 3, a bottom view). The part 10 is moved via an operating handle 12 and levers 13 and 14, the latter pivoting about an axis 15. The lever 14 is coupled to the sliding carriage.

When the two boards are juxtaposed (the position of FIG. 3), the mechanism is irreversible (col. 2, line 34) so that pushing on part 10 cannot move the lever 12 and separate the two boards. This is due to the way the levers are "arranged" (col. 2, line 32). However, when the two boards are separated, part 10 is free to move along the slide.

U.S. Pat. No. 2,888,759 discloses an ironing board with a pop-up "midget board" 16 which arises from a central cutout in the main board. The motion of the midget board is out of the plane defined by the two boards when they are aligned.

EP 0,458,503 also shows a board with a smaller portion which pops up (see FIG. 5).

U.S. Pat. No. 3,698,110 shows a sleeve board which pivotally swings out from the main board.

The prior art does not disclose or suggest any auxiliary ("sleeve") board with any means for positively holding a position of the sleeve board relative to the main board.

SUMMARY OF THE INVENTION

Accordingly, the present invention has an object, among others, to overcome deficiencies in the prior art, such as noted above.

The invention provides a position lock to hold a sleeve board in a position offset from the main board. (This offset position is typically used for ironing sleeves and other articles, hence the name "sleeve board".) The sleeve board can be slid toward the main board by overcoming the lock. Preferably, the lock includes a detent and is overcome just by pushing sideways on the sleeve board with a force above a minimum or threshold force. The detent can be of the tooth-and-indentation type, where the tooth is releasably held in the indentation by a lateral force from gravity or mechanical force (e.g., a spring). Once it comes adjacent the main board or abuts the main board and is in a juxtaposed position, a second lock holds the sleeve board in the juxtaposed position. The second lock is preferably similar to the first lock.

BRIEF DESCRIPTION OF THE DRAWING

The above and other objects and the nature and advantages of the present invention will become more apparent from the following detailed description of an embodiment[s] taken in conjunction with drawings, in which.

DETAILED DESCRIPTION OF THE PREFERRED EMBODIMENT

Here, and in the following claims:

"coplanar" means generally or approximately lying in the same plane (or gradually curving surface);

"detent" means a releasable stopping (holding or locking) mechanism including an indentation, notch, groove, hole, depression, or similar device, into which a mating device such as a tooth or projection can be fit;

"gravity-locked" means that stopping or holding force is exerted directly or indirectly by a weight; for example, a heavy bar with a tooth that rests in an indentation on a surface is releasably held from sliding along the surface by the weight of the bar.;

"releasable", of a lock, means that the device can be moved from the locked position by exerting a force above some minimum or threshold force, or by exerting some positive action (involving a predetermined amount of force) on a release (e.g., a push-button release).

Figure 1:
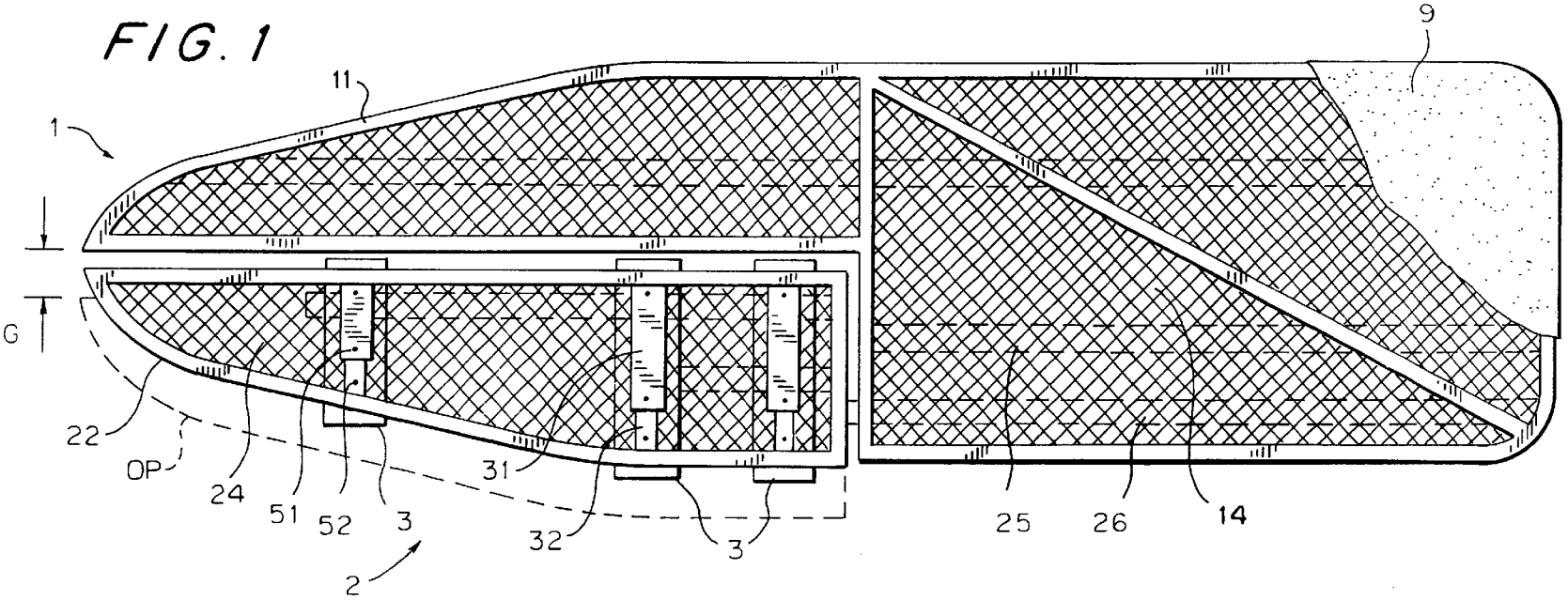
FIG. 1 is a plan view, from above, of the invention.

FIG. 1 shows the ironing board of the present invention as seen from above. The board has the conventional shape for hand-ironing, with an outline that is bilaterally symmetrical about a central symmetry line (not indicated on the drawing). There are two board portions, a larger main board 1 and a smaller board or "sleeve" board 2. The sleeve board 2 is juxtaposed to the main board 1, with the border therebetween preferably being L-shaped. The longer arm of the L preferably coincides with the central line of symmetry, but may be located at any place and at any reasonable angle.

The sleeve board 2 is selectively movable laterally to an offset position, which is indicated in FIG. 1 by dashed outline OP. In this position the narrow end of the sleeve board is available for ironing sleeves and other garments or garment portions. In the offset position a gap G is opened between the main board 1 and the sleeve board 2. In the offset position the ironing board the gap G is between the central symmetry line and an inner side of the sleeve board.

Each board preferably has its own metal frame 11, 22 and expanded mesh surface 14, 24 under a fabric cover 9, which may serve as the actual ironing surface. (A separate fabric cover for the sleeve portion 2 is not shown for the sake of clarity. A majority of the cover 9 over the main board 1 is cut away to show metallic parts.)

A slide mechanism 3 lets the sleeve board 2 move between the offset position OP and the illustrated juxtaposed position. The slide mechanism has two stops which releasably hold the sleeve board at either position.

Figure 2:
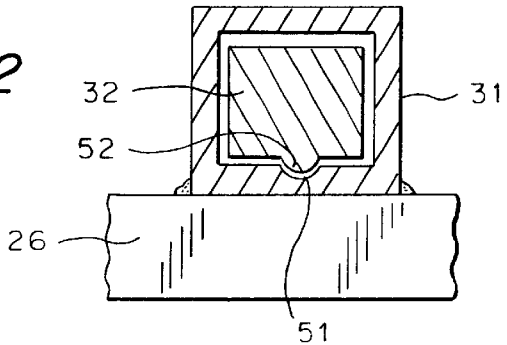
FIG. 2 is a sectional view through one of the three slide mechanisms of FIG. 1.

FIGS. 1 and 2 show a preferred embodiment of the slide mechanism 3. A runner 32, which is attached to the sleeve board 2, slides in a telescopic fashion within a guide tube 31 (see FIG. 2) which is attached to the main board 1 via main-board frame members 25 and 26, which extend under the sleeve board 2. The guide tube 31 is preferably fastened to the frame members 25 and 26 permanently (e.g., by welding, rivets, or the like) or semi-permanently (e.g., with screws, or nuts and bolts or the like). The runner 32 is preferably attached to the inside of a perimeter frame rail 22 of the sleeve board 2 with screws or the like passing horizontally through the frame 22 into either end of the guide tube 31, which may be threaded to receive them. The slide mechanism 3 is disposed below the mesh 24 forming the ironing surface of the sleeve board 2.

The runner 32 can shuttle back and forth by sliding within the guide tube 31, opening and closing the gap G. To hold the sleeve board 2 in desired positions, the mechanism 3 includes stops which releasably lock or hold the boards in the desired relative position or positions.

FIG. 2 best shows the preferred stops which each include a respective tooth 52 in the runner 32 and an indentation 51 in the guide tube 31. In this embodiment the detent is gravity-locked, by the weight of the sleeve board which forces down the tooth 52 into the indentation 51 to gravity-lock the sleeve board. (Here and in the claims the tooth "falls" into the indentation whether the tooth is above or below the indentation, and regardless of whether the element with the tooth or the element with the indentation moves up or down.)

Although preferably the sleeve board is gravity-locked, the present invention also includes spring-locking (e.g., a spring-loaded ball pressed into an indentation), locking released by positive hand action by the user (e.g. a bolt-action mechanism), and any other releasable locking.

FIG. 1 shows three parallel slide mechanisms, as preferred; however, the present invention can function with only one such slide, although it functions better with at least two. For clarity only the central runner and guide tube are numbered. On the left-hand slide mechanism the indentation 51 and tooth 52 are labeled. The other slide mechanisms are similar. If two or three slides are provided as is preferred, a locking mechanism is only necessary for one of such slides.

In FIG. 1 the indentations and teeth are indicated by dots to indicate their positions, although in a view from above they are not actually visible with the mechanism as shown. In the position shown where the gap G is closed up (or nearly closed up) the labeled tooth 52 fits into (or is near) an indentation 51.

Two stops are preferably located at the respective extreme ends of the travel of the sleeve board, or near the extreme ends, or midway. More than two stops are within the scope of the invention. Any additional stop or stops intermediate the first stop and the second stop can be provided, for example, by means of an additional indentation.

The longer frame member, 25, is nearer to the central symmetry line and the shorter frame member, 26, is disposed under the wider end.

The telescoping parts of the slides are shown as having rectangular cross-sections, but it will be understood that other cross-sectional shapes can be used instead.

Legs or other support for the board (not shown) are preferably attached to the main board 1. Conventional fold-up legs can be attached to the main board either releasably (e.g., screws) or non-releasably (e.g., rivets or welding the legs to a metal frame of the main board. Legs can also be attached to the sleeve board; for example, an auxiliary leg.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. An ironing board, adapted to use with a hand-held iron, the ironing board comprising:

a main board and a smaller sleeve board;

a slide mechanism comprising a runner telescopically slidable within a guide tube, said slide mechanism coupling the main board to the sleeve board, the slide mechanism adapted to motion of the sleeve board between (1) an offset position in which a gap separates the main board and the sleeve board, and wherein the main board and the sleeve board are coplanar, and (2) a juxtaposed position in which the gap is substantially absent and the main board and the sleeve board are coplanar;

the slide mechanism further comprising a first stop releasably holding the sleeve board at the juxtaposed position, and a second stop releasably holding the sleeve board at the offset position;

whereby the sleeve board is releasably held at either one of the juxtaposed position and the offset position.

2. The ironing board according to claim 1, in which the first stop and the second stop comprise detents.

3. The ironing board according to claim 2, in which the detents each comprise a respective indentation and a respective tooth fitting therein.

4. The ironing board according to claim 2, in which the detents are gravity-locked.

5. The ironing board according to claim 4, in which the detents each comprise a respective indentation and a respective tooth fitting therein, and in which the tooth falls into the indentation.

6. The ironing board according to claim 1, in which the runner is attached to the sleeve board and the guide tube is attached to the main board.

7. The ironing board according to claim 1, in which the slide mechanism comprises a plurality of parallel slide devices.

8. An ironing board, adapted to use with a hand-held iron, the ironing board comprising:

a main board and a smaller sleeve board;

a slide mechanism coupling the main board to the sleeve board, the slide mechanism adapted to motion of the sleeve board between (1) an offset position in which a gap separates the main board and the sleeve board, and wherein the main board and the sleeve board are coplanar, and (2) a juxtaposed position in which the gap is substantially absent and the main board and the sleeve board are coplanar;

the slide mechanism comprising a first stop releasably holding the sleeve board at the juxtaposed position, and a second stop releasably holding the sleeve board at the offset position;

whereby the sleeve board is releasably held at either one of the juxtaposed position and the offset position; and in which the slide mechanism comprises a plurality of parallel slide devices, and further comprises a first plurality of the first stop and a second plurality of the second stop.

9. The ironing board according to claim 8, in which each of the slide devices includes a respective one of the first plurality and a respective one of the second plurality.

10. The ironing board according to claim 1, comprising an additional stop intermediate the first stop and the second stop.

11. The ironing board according to claim 1, comprising a main board frame including a frame member extending under the sleeve board, and in which the slide mechanism is attached to the frame member.

12. The ironing board according to claim 1, in which the gap includes a generally constant width in the offset position.

13. An ironing board, adapted to use with a hand-held iron, the ironing board comprising:

a main board and a smaller sleeve board;

a slide mechanism coupling the main board to the sleeve board, the slide mechanism adapted to motion of the sleeve board between (1) an offset position in which a gap separates the main board and the sleeve board, and wherein the main board and the sleeve board are coplanar, and (2) a juxtaposed position in which the gap is substantially absent and the main board and the sleeve board are coplanar;

the slide mechanism comprising a first stop releasably holding the sleeve board at the juxtaposed position, and a second stop releasably holding the sleeve board at the offset position;

whereby the sleeve board.is releasably held at either one of the juxtaposed position and the offset position, and in which (i) in the juxtaposed position the ironing board comprises a bilaterally-symmetrical outline shape having a central symmetry line, and (ii) in the offset position the gap is between the central symmetry line and an inner side of the sleeve board.

14. The ironing board according to claim 13, in which the first stop and the second stop comprise detents.

15. The ironing board according to claim 14, in which the detents each comprise a respective indentation and a respective tooth fitting therein.

16. The ironing board according to claim 14, in which the detents are gravity-locked.

17. An ironing board, adapted to use with a hand-held iron, the ironing board comprising:

a main board and a smaller sleeve board;

a slide mechanism coupling the main board to the sleeve board, the slide mechanism adapted to motion of the sleeve board between (1) an offset position in which a gap separates the main board and the sleeve board, and wherein the main board and the sleeve board are coplanar, and (2) a juxtaposed position in which the gap is substantially absent and the main board and the sleeve board are coplanar;

the slide mechanism comprising a first stop releasably holding the sleeve board at the juxtaposed position, and a second stop releasably holding the sleeve board at the offset position;

whereby the sleeve board is releasably held at either one of the juxtaposed position and the offset position;

a main board frame including a frame member extending under the sleeve board, and in which the slide mechanism is attached to the frame member, the sleeve board including a narrow end and a wider end, the ironing board comprising at least a pair of frame members including a longer frame member and a shorter frame member, and the shorter frame member being disposed under the wider end.

18. The ironing board according to claim 17, in which the first stop and the second stop comprise detents.

19. The ironing board according to claim 18, in which the detents each comprise a respective indentation and a respective tooth fitting therein.

20. The ironing board according to claim 18, in which the detents are gravity-locked.

* * * * *